United States Patent [19]

Morrell

[11] Patent Number: 4,694,216

[45] Date of Patent: Sep. 15, 1987

[54] CATHODE-RAY TUBE HAVING AN INTERNAL MAGNETIC SHIELD

[75] Inventor: Albert M. Morrell, Lancaster, Pa.

[73] Assignee: RCA Corporation, Princeton, N.J.

[21] Appl. No.: 867,033

[22] Filed: May 27, 1986

[51] Int. Cl.[4] ..... H01J 29/06; H01J 29/07

[52] U.S. Cl. ..... 313/402; 313/407

[58] Field of Search ..... 313/402, 407

[56] References Cited

U.S. PATENT DOCUMENTS

| | | | |
|---|---|---|---|
| 3,549,932 | 12/1970 | Lindeman | 313/85 |
| 3,821,583 | 6/1974 | Steiner | 313/407 |
| 4,571,521 | 2/1986 | Gallaro et al. | 313/402 |
| 4,622,490 | 11/1986 | Benway | 313/402 |

*Primary Examiner*—David K. Moore

*Assistant Examiner*—K. Wieder

*Attorney, Agent, or Firm*—E. M. Whitacre; D. H. Irlbeck; T. H. Magee

[57] ABSTRACT

A cathode-ray tube has a faceplate panel joined to a funnel thereof along a sidewall of the panel, and has an internal magnetic shield disposed therein proximate an inner surface of the funnel and connected along one end thereof to a back portion of a shadow-mask frame oriented orthogonally to a central axis of the tube and supported adjacent the sidewall. An apertured shadow mask is connected along an edge thereof to a front portion of the shadow-mask frame opposite the back portion. Along the direction of the central axis, the one end of the magnetic shield overlaps the corresponding edge of the shadow mask around substantially all of the shadow-mask frame.

7 Claims, 3 Drawing Figures

CATHODE-RAY TUBE HAVING AN INTERNAL MAGNETIC SHIELD

BACKGROUND OF THE INVENTION

This invention pertains to a cathode-ray tube having an internal magnetic shield attached to a shadow-mask frame therein.

A shadow-mask cathode-ray tube typically has a magnetic shield to reduce the influence of magnetic fields on electron beam trajectories as a cathodoluminescent screen of the tube is scanned. In particular, the angles of incidence of the electron beams at every point on the shadow mask must not change significantly from the design values, or the beams will move away from their intended landing positions on the screen. The magnetic shield may be disposed either outside the tube as an external magnetic shield, or inside the tube as an internal magnetic shield.

The internal magnetic shield is usually made of 0.10 to 0.18 mm thick cold-rolled steel and is fastened to a shadow-mask frame by resilient clamping pins. The frame is supported by springs that engage mounting studs that extend inwardly from a glass rectangular faceplate panel of the tube. During tube fabrication, the internal magnetic shield is fastened to the frame prior to the steps of frit sealing a sidewall of the faceplate panel to a glass funnel of the cathode-ray tube. The internal magnetic shield is designed to fit into the funnel and to be as close to the funnel wall as possible. However, it should not touch the funnel to avoid any friction between the shield and a conductive anode coating on the inner surface of the glass funnel.

In order to be effective, a magnetic shield must be thoroughly demagnetized (degaussed) in position by subjecting the magnetic shield to the field from a degaussing coil energized by alternating current of progressively reduced amplitude. Degaussing is normally expressed in terms of ampere turns, and typically for an internal magnetic shield, would be in the order of 1500 A turns. This procedure effectively reorients magnetic domains in the shield and tends to leave it magnetized so as to nullify the field within the shield. The degaussing coil is typically built into the receiver, and the alternating current is automatically reduced from a high value to zero every time the receiver is turned on. This ensures against deterioration of color purity and white uniformity caused by changing magnetic field environments. After degaussing, the extent to which an electron beam strikes the cathodoluminescent screen closer to its intended landing position, measured in micrometers of residual misregister, is an indication of the effectiveness of degaussing recovery.

Using the same amount of degaussing current, the degaussing recovery for a cathode-ray tube with an additional external magnetic shield is usually better than that for a cathode-ray tube with an internal magnetic shield only. However, an external magnetic shield adds to the manufacturing cost. Consequently, in order to achieve a comparable degree of color purity using only an internal magnetic shield, it is necessary to improve its inherent degaussing recovery. The present invention provides for an internal magnetic shield showing a significant improvement in residual misregister after degaussing.

SUMMARY OF THE INVENTION

The present invention comprises a cathode-ray tube having a faceplate panel joined to a funnel thereof along a sidewall of the panel, and having an internal magnetic shield disposed therein proximate an inner surface of the funnel and connected along one end thereof to a back portion of a shadow-mask frame oriented orthogonally to a central axis of the tube and supported adjacent the sidewall. An apertured shadow mask is connected along an edge thereof to a front portion of the shadow-mask frame opposite the back portion. Along the direction of the central axis, the one end of the magnetic shield overlaps the corresponding edge of the shadow mask around substantially all of the shadow-mask frame.

DETAILED DESCRIPTION OF THE PREFERRED EMBODIMENTS

Figure 1:
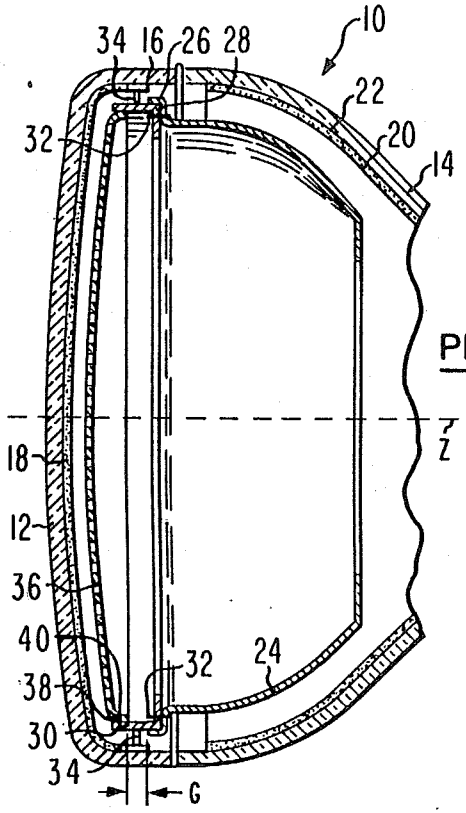
Fig. 1 PRIOR ART
FIG. 1 is a cross-sectional view illustrating a cathode-ray tube having a prior-art internal magnetic shield disposed therein.

FIG. 1 shows a cathode-ray tube 10 having a faceplate panel 12 joined to a funnel 14 thereof along a sidewall 16 of the panel 12. A cathodoluminescent screen 18 is disposed on the inner surface of the panel 12, and a conductive coating 20 is disposed on the inner surface 22 of the funnel 14 which serves as the positive anode for the tube 10. A prior-art internal magnetic shield 24 is disposed within the tube 10, with one end 26 thereof proximate the sidewall 16, and extending backward along the inner surface 22 of the funnel 14. The magnetic shield 24 is connected along the one end 26 to a back portion 28 of a shadow-mask frame 30 oriented orthogonally to a central axis of the tube 10, shown as dotted line Z. The shield 24 is fastened to the frame 30 by resilient clamping pins 32, which are inserted through aligned apertures disposed in both the shield 24 and the frame 30. The shadow-mask frame 30 is supported adjacent the sidewall 16 by mounting studs 34 which extend inwardly from the faceplate panel 12. Since the sidewall 16 of the faceplate panel 12 is generally rectangularly shaped, the typical internal magnetic shield 24 has four corners.

A multi-apertured shadow mask 36 is connected along an edge 38 thereof to a front portion 40 of the shadow-mask frame 30 opposite the back portion 28, as shown in FIG. 1. In addition to the internal magnetic shield 24, the shadow mask 36 itself makes a significant contribution to the total shielding of the cathode-ray tube 10. The shadow mask 36 is typically made of 0.15 mm thick cold-rolled steel, and is welded to the frame 30. The mask 36 may be welded to the inside of the frame 30, as shown in FIG. 1, to form a MIFA (Mask Inside Frame Assembly), or may be welded to the outside of the frame 30 to form a MOFA (Mask Outside Frame Assembly). Using either the MIFA or MOFA, a small gap, shown as distance G in FIG. 1, is created between the edge 38 of the shadow mask 36 and the one end 26 of the internal magnetic shield 24 around the perimeter of the shadow-mask frame 30. Heretofore, it was assumed that the frame 30, since it was also made of a magnetic material, albeit different from that of the magnetic shield 24, also performed a shielding function along the gap G.

Figure 2:
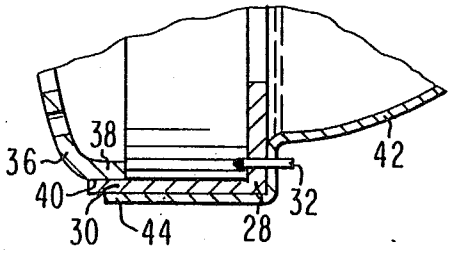
FIG. 2 is a cross-sectional view illustrating one embodiment of the present overlapping internal magnetic shield.

FIG. 2 shows one embodiment of an overlapping internal magnetic shield 42 which provides for a significant improvement in degaussing recovery. Applicant has discovered that the residual misregister after degaussing is improved substantially by overlapping, along the direction of the central axis Z, the one end 44 of the internal magnetic shield 42 with the corresponding edge 38 of the shadow mask 36 around substantially all of the shadow-mask frame 30. Preferably, the one end 44 of the internal magnetic shield 42 is extended forward to overlap the edge 38 of the shadow mask 36 along the sides of the frame 30 except in the corners thereof. FIG. 2 shows a MIFA structure wherein the shadow mask 36 is connected to the inside of the frame 30. Since the internal magnetic shield 42 is connected to the outside of the frame 30, the mask 36 and shield 42 overlap but do not actually contact each other, as shown in FIG. 2.

Figure 3:
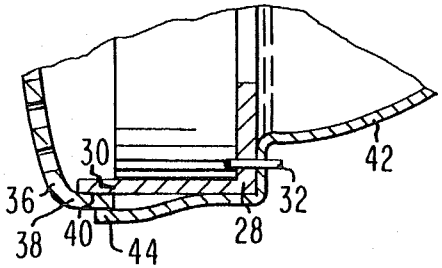
FIG. 3 is a cross-sectional view illustrating a second embodiment of the present overlapping internal magnetic shield.

FIG. 3 shows a second embodiment of the present overlapping internal magnetic shield 42 incorporated into a MOFA structure. Since the magnetic shield 42 is also connected to the outside of the frame 30, the shield 42 actually contacts the shadow mask 36, although such contact is not necessary to achieve the benefits of the present invention.

The one end 44 of the internal magnetic shield 42 may also be extended around the inside of the shadow-mask frame 30 in order to overlap the shadow mask 36 in either the MIFA or MOFA configuration. It is not necessary that the magnetic shield 42 comprise one integral piece. The overlapping portion of the shield 42 may in fact comprise two or more pieces, particularly in the aforementioned embodiment where the shield 42 extends around the inside of the frame 30.

In the present invention, it is important that the one end 44 of the magnetic shield 42 actually overlap the corresponding edge 38 of the shadow mask 36. This overlapping distance, along the direction of the central axis Z, should be at least twice the thickness of the shadow-mask frame 30 in order to achieve satisfactory magnetic coupling and, hence, improved magnetic recovery. Preferably, the one end 44 of the internal magnetic shield 42 extends substantially to the front of the shadow-mask frame 30, as shown in FIGS. 2 and 3.

The TABLE below shows data values for residual misregister recorded in tests performed on RCA 27V SP cathode-ray tubes with different types of magnetic shielding including that of the present invention. The first row in the TABLE represents a cathode-ray tube having an external magnetic shield and a prior-art internal magnetic shield. The second row represents a tube having a prior-art internal magnetic shield but no external magnetic shield. The third row represents a tube having the present overlapping internal magnetic shield. In each row, data values for residual misregister at the ends of the diagonal, major and minor panel axes and also at the panel center were recorded after changes in the relative magnetic field along the Vertical Y axis (100 mG), central Z axis (250 mG) and X axis (250 mG) directions. The recorded data values show that the overlapping internal magnetic shield (row 3) provides a significant improvement in residual misregister over the prior-art internal magnetic shield (row 2). For a 250 mG change in magnetic field along the central Z axis direction, the overlapping shield provides even better degaussing recovery time than that achieved with an external magnetic shield (row 1).

TABLE

| EXTERNAL MAGNETIC SHIELD | INTERNAL MAGNETIC SHIELD | OVERLAPPING INTERNAL MAGNETIC SHIELD | RESIDUAL MISREGISTER (MICROMETERS) 100 MILLIGAUSS CHANGE ALONG THE VERTICAL Y AXIS DIRECTION | | | |
|---|---|---|---|---|---|---|
| | | | DIAGONAL | MAJOR | MINOR | CENTER |
| YES | YES | NO | 6 | −1 | 1 | −1 |
| NO | YES | NO | 12 | 14 | 8 | 7 |
| NO | YES | YES | 9 | 10 | 6 | 6 |

| EXTERNAL MAGNETIC SHIELD | INTERNAL MAGNETIC SHIELD | OVERLAPPING INTERNAL MAGNETIC SHIELD | RESIDUAL MISREGISTER (MICROMETERS) 250 MILLIGAUSS CHANGE ALONG THE CENTRAL Z AXIS | | 250 MILLIGAUSS CHANGE ALONG THE X AXIS DIRECTION |
|---|---|---|---|---|---|
| | | | DIAGONAL | MINOR | DIAGONAL |
| YES | YES | NO | 40 | 22 | 18 |
| NO | YES | NO | 46 | 24 | 34 |
| NO | YES | YES | 37 | 18 | 28 |

It is hypothesized that the shadow-mask frame 30 presents a relatively high magnetic reluctance during degaussing, thereby creating a gap in the magnetic shielding which degrades the residual misregister in the cathode-ray tube 10. Applicant has discovered that this residual misregister after degaussing may be improved substantially by overlapping the one end 44 of the magnetic shield 42 with the edge 38 of the shadow mask 36 around substantially all of the shadow-mask frame 30. The present magnetic shield 42 has an improved degaussing recovery which, under similar operating conditions, achieves a level of color purity heretofore unattainable with the prior-art internal magnetic shield, thereby providing an acceptable alternative to the more expensive addition of an external magnetic shield.

What is claimed is:

1. In a cathode-ray tube having a faceplate panel joined to a funnel thereof along a sidewall of said panel, and having an internal magnetic shield disposed therein proximate an inner surface of said funnel and connected along one end thereof to a back portion of a shadow-mask frame oriented orthogonally to a central axis of said tube and supported adjacent said sidewall, a multi-apertured shadow mask being connected along an edge thereof to a front portion of said shadow-mask frame opposite the back portion, the improvement comprising the one end of said magnetic shield overlapping, along the direction of said central axis, the corresponding edge of said shadow mask around substantially all of said shadow-mask frame.

2. A cathode-ray tube as defined in claim 1 wherein the one end of said magnetic shield is extended forward to overlap the edge of said shadow mask.

3. A cathode-ray tube as defined in claim 1 wherein said shadow mask is connected to the outside of said shadow-mask frame and wherein said magnetic shield is connected to the outside of said shadow-mask frame, in contact with said shadow mask.

4. A cathode-ray tube as defined in claim 1 wherein said shadow mask is connected to the inside of said shadow-mask frame and wherein said magnetic shield is connected to the outside of said shadow-mask frame.

5. A cathode-ray tube as defined in claim 4 wherein the overlapping distance along the direction of said central axis comprises at least twice the thickness of said shadow-mask frame.

6. A cathode-ray tube as defined in claim 5 wherein the one end of said magnetic shield extends substantially to the front of said shadow-mask frame.

7. A cathode-ray tube as defined in claim 6 wherein said shadow-mask frame is rectangular shaped and wherein the one end of said magnetic shield overlaps the edge of said shadow mask along the sides of said frame except in the corners thereof.

* * * * *